US008540027B2

(12) United States Patent
Wesson et al.

(10) Patent No.: US 8,540,027 B2
(45) Date of Patent: Sep. 24, 2013

(54) METHOD AND APPARATUS FOR SELECTIVE DOWN HOLE FLUID COMMUNICATION

(75) Inventors: David S. Wesson, Granbury, TX (US); Kevin R. George, Cleburne, TX (US); Philip M. Snider, Houston, TX (US)

(73) Assignee: GEODynamics, Inc., Millsap, TX (US)

( * ) Notice: Subject to any disclaimer, the term of this patent is extended or adjusted under 35 U.S.C. 154(b) by 1681 days.

(21) Appl. No.: 11/469,255

(22) Filed: Aug. 31, 2006

(65) Prior Publication Data

US 2008/0053658 A1 Mar. 6, 2008

(51) Int. Cl.
*E21B 29/00* (2006.01)

(52) U.S. Cl.
USPC ..... 166/298; 166/308.1; 166/299

(58) Field of Classification Search
USPC ..... 166/298, 297, 308.1, 299
See application file for complete search history.

(56) References Cited

U.S. PATENT DOCUMENTS

| | | | | |
|---|---|---|---|---|
| 2,259,564 | A | | 10/1941 | Holland |
| 3,097,693 | A | | 7/1963 | Terrel |
| 3,426,849 | A | | 2/1969 | Brumble, Jr. |
| 3,426,850 | A | | 2/1969 | McDuffie, Jr. |
| 3,468,386 | A | | 9/1969 | Johnson |
| 3,612,189 | A | * | 10/1971 | Brooks et al. ..... 175/4.54 |
| 3,684,008 | A | | 8/1972 | Garrett |
| 4,023,167 | A | | 5/1977 | Wahlstrom |
| 4,572,293 | A | | 2/1986 | Wilson et al. |
| 4,599,182 | A | | 7/1986 | Young et al. |
| 4,606,409 | A | | 8/1986 | Peterson et al. |
| 4,630,044 | A | | 12/1986 | Polzer |
| 4,656,463 | A | | 4/1987 | Anders et al. |
| 4,698,631 | A | | 10/1987 | Kelly, Jr. et al. |
| 4,808,925 | A | | 2/1989 | Baird |
| 4,827,395 | A | | 5/1989 | Anders et al. |
| 4,886,126 | A | | 12/1989 | Yates, Jr. |
| 4,917,189 | A | * | 4/1990 | George et al. ..... 166/297 |
| 5,103,912 | A | * | 4/1992 | Flint ..... 166/297 |
| 5,105,742 | A | | 4/1992 | Sumner |
| 5,142,128 | A | | 8/1992 | Perkin et al. |
| 5,191,936 | A | | 3/1993 | Edwards et al. |
| 5,202,680 | A | | 4/1993 | Savage |
| 5,224,545 | A | * | 7/1993 | George et al. ..... 166/297 |
| 5,279,366 | A | | 1/1994 | Scholes |

(Continued)

FOREIGN PATENT DOCUMENTS

| | | |
|---|---|---|
| CA | 2173699 | 4/1996 |
| EP | 0 013 494 A1 | 7/1980 |

(Continued)

OTHER PUBLICATIONS

Inside Circular Cutters/Outside Circular Cutters, JRC Technical Data Sheets, Jet Research Center, Inc., Feb. 1, 1970, Arlington, Texas, pp. 1-4.

(Continued)

*Primary Examiner* — Cathleen Hutchins

(57) ABSTRACT

Methods and apparatus for perforating a formation in a wellbore without perforating a well bore casing. The methods and apparatus include an external casing perforating device configured so as not to perforate the casing. The interior of the perforating device serves as a fluid flow path between the casing and the formation following perforation and a valve in the casing selectively opens and closes the flow path.

33 Claims, 4 Drawing Sheets

(56) References Cited

U.S. PATENT DOCUMENTS

| | | | | |
|---|---|---|---|---|
| 5,355,957 | A | 10/1994 | Burleson et al. | |
| 5,361,838 | A | 11/1994 | Kilgore | |
| 5,457,447 | A | 10/1995 | Ghaem et al. | |
| 5,467,823 | A | 11/1995 | Babour et al. | |
| 5,479,860 | A | 1/1996 | Ellis | |
| 5,495,237 | A | 2/1996 | Yuasa et al. | |
| 5,497,140 | A | 3/1996 | Tuttle | |
| 5,505,134 | A | 4/1996 | Brooks et al. | |
| 5,608,199 | A | 3/1997 | Clouse, III et al. | |
| 5,626,192 | A | 5/1997 | Connell et al. | |
| 5,632,348 | A | 5/1997 | Yunan | |
| 5,654,693 | A | 8/1997 | Cocita | |
| 5,660,232 | A * | 8/1997 | Reinhardt | 166/297 |
| 5,680,459 | A | 10/1997 | Hook et al. | |
| 5,682,143 | A | 10/1997 | Brady et al. | |
| 5,704,426 | A | 1/1998 | Rytlewski et al. | |
| 5,720,345 | A | 2/1998 | Price et al. | |
| 5,829,538 | A * | 11/1998 | Wesson et al. | 175/4.6 |
| 5,911,277 | A | 6/1999 | Hromas et al. | |
| 6,018,501 | A | 1/2000 | Smith et al. | |
| 6,025,780 | A | 2/2000 | Bowers et al. | |
| 6,070,662 | A | 6/2000 | Ciglenec et al. | |
| 6,078,259 | A | 6/2000 | Brady et al. | |
| 6,135,206 | A | 10/2000 | Gano et al. | |
| 6,151,961 | A | 11/2000 | Huber et al. | |
| 6,257,338 | B1 | 7/2001 | Kilgore | |
| 6,333,700 | B1 | 12/2001 | Thomeer et al. | |
| 6,343,649 | B1 | 2/2002 | Beck et al. | |
| 6,359,569 | B2 | 3/2002 | Beck et al. | |
| 6,386,288 | B1 * | 5/2002 | Snider et al. | 166/298 |
| 6,481,505 | B2 | 11/2002 | Beck et al. | |
| 6,497,280 | B2 | 12/2002 | Beck et al. | |
| 6,538,576 | B1 | 3/2003 | Schultz et al. | |
| 6,588,505 | B2 | 7/2003 | Beck et al. | |
| 6,820,693 | B2 | 11/2004 | Hales et al. | |
| 6,966,377 | B2 * | 11/2005 | Johnson et al. | 166/297 |
| 6,989,764 | B2 | 1/2006 | Thomeer et al. | |
| 7,278,484 | B2 * | 10/2007 | Vella et al. | 166/298 |
| 2003/0230406 | A1 * | 12/2003 | Lund | 166/278 |
| 2004/0206503 | A1 * | 10/2004 | Bell et al. | 166/297 |
| 2005/0178554 | A1 * | 8/2005 | Hromas et al. | 166/313 |
| 2005/0263286 | A1 * | 12/2005 | Sheffield | 166/297 |
| 2007/0193740 | A1 * | 8/2007 | Quint | 166/250.07 |

FOREIGN PATENT DOCUMENTS

| | | | |
|---|---|---|---|
| EP | 0 412 535 | B1 | 2/1991 |
| EP | 0 651 132 | A2 | 5/1995 |
| EP | 0 730 083 | A2 | 9/1996 |
| FR | 1033631 | | 4/1953 |
| SU | 1657627 | A1 | 6/1991 |
| WO | 01/18357 | A2 | 3/2001 |
| WO | 01/73423 | A1 | 10/2001 |

OTHER PUBLICATIONS

Den-Con Tool Co., 1994-95 General Catalog, pp. 1-3.

* cited by examiner 107
101
200
105
211
220
222
221
209
204
106
202
102
205
102
207
206
108
208
104
210
100

METHOD AND APPARATUS FOR SELECTIVE DOWN HOLE FLUID COMMUNICATION

BACKGROUND OF THE INVENTION

1. Field of the Invention

Embodiments of the present invention generally relate to apparatus and methods for selectively producing and/or treating one or more hydrocarbon bearing subterranean formations. More particularly, embodiments of the present invention relate to apparatus and methods for completing a subterranean well in which multiple zones may be selectively treated and produced. More particularly still, embodiments of the present invention relate to apparatus and methods for perforating the one or more formation(s) and selectively establishing fluid communication between the one or more formations and a well bore.

2. Description of the Related Art

In the drilling of oil and gas wells, a wellbore is formed using a drill bit disposed at a lower end of a drill string that is urged downwardly into the earth. After drilling to a predetermined depth or when circumstances dictate, the drill string and bit are removed and the wellbore is lined with a string of casing. An annular area is thereby formed between the string of casing and the formation. A cementing operation is then conducted in order to fill the annular area with cement. The combination of cement and casing strengthens the wellbore and facilitates the isolation of certain areas or zones behind the casing including those containing hydrocarbons. The drilling operation is typically performed in stages and a number of casing or liner strings may be run into the wellbore until the wellbore is at the desired depth and location.

The casing and cement and an adjacent hydrocarbon bearing formation or formations are typically perforated using a series of explosive or "perforating" charges. Such a series of charges may be lowered into the well bore casing inside of an evacuated tube and such a charge containing tube is a type of what is generally known as a "perforating gun." When detonated, the charges pierce or perforate the walls of the casing and penetrate any adjacent cement and the adjacent formation thereby allowing fluid communication between the interior of the casing and the formation. Production fluids may flow into the casing from the formation and treatment fluids may be pumped from the casing interior into the formation through the perforations made by the charges.

In many instances a single wellbore may traverse multiple hydrocarbon bearing formations that are otherwise isolated from one another within the Earth. It is frequently desirable to treat such hydrocarbon bearing formations with pressurized treatment fluids prior to producing those formations or at some other time during the useful life of a well. In order to ensure that a proper treatment is performed on a desired formation, that formation is typically isolated from other formations traversed by the wellbore. It may also be desirable to produce a given formation or formations in isolation from other formations common to the traversing wellbore. Examples of selective formation stimulation treatment and production techniques are described in U.S. Pat. No. 5,823,265 to Crow et. al., and that patent is incorporated herein, in its entirety, by reference.

To achieve sequential treatment of multiple formations in a new well, the casing adjacent a lowermost formation is perforated while the casing portions adjacent other formations common to the wellbore are left un-perforated. The perforated zone is then treated by pumping treatment fluid under pressure into that zone through the perforations. Following treatment, a downhole plug is set above the perforated zone to isolate that zone. The next sequential zone up the wellbore ("up hole") is then perforated, treated and isolated with an above positioned plug. That process is repeated until all of the zones of interest have been treated. Subsequent production of hydrocarbons from these zones requires that the sequentially set plugs be removed from the well. Such removal requires that removal equipment be run into the well on a conveyance string which string may typically be wire line, coiled tubing or jointed pipe.

Formation isolation in an existing perforated well may be achieved by proper placement of straddle packer arrangements and/or plugs. While selective treatment can be achieved using such equipment, the process and equipment can be complicated and expensive.

In the above described treatment processes the perforation and plug setting or straddle packer setting steps each represent a separate excursion or "trip" into and out of the wellbore with the required equipment. Each trip takes additional time and adds complexity to the overall effort. Such factors can be exacerbated when operating in wellbores that are not vertical and specialized conveyance equipment is often required in "horizontal" wellbores.

Therefore, there is a need for improved methods and apparatus for selectively establishing fluid communication with one or more formations. Further, there is a need for improved systems that can perforate multiple zones selectively isolate the wellbore from the zones. Further still, there is a need for improved methods and apparatus capable of selectively establishing fluid communication between a wellbore and one or more zones traversed by that wellbore.

SUMMARY OF THE INVENTION

In accordance with the present invention there is provided generally a formation perforating system including apparatus for selectively providing fluid communication between an interior of a well bore tubular and a perforated formation. Further provided are methods for perforating a well bore formation and selectively establishing fluid communication between the perforated formation and an interior of a well bore tubular.

More specifically the present apparatus comprises an apparatus for penetrating a formation and selectively establishing fluid communication between a well bore tubular and the formation, comprising:

- a well bore tubular having at least one aperture through a wall thereof and comprising a valve member having a first position wherein the aperture is obstructed and a second position wherein the aperture is open; and
- at least one energetic device positioned exterior of the tubular and configured to perforate, penetrate and/or fracture a formation surrounding the tubular without perforating the tubular.

Further, the present methods comprise selectively establishing fluid communication between an interior of a well bore tubular and an adjacent formation, comprising:

- providing a well bore tubular and an energetic device adjacent a formation of interest;
- perforating, penetrating and/or fracturing the formation of interest while not perforating the well bore tubular, using the energetic device; and
- opening a fluid flow path between the formation of interest and an interior of the well bore tubular.

BRIEF DESCRIPTION OF THE DRAWINGS

So that the above recited features can be understood in more detail, a more particular description of the features, briefly summarized above, may be had by reference to embodiments, some of which are illustrated in the appended drawings. It is to be noted, however, that the appended drawings illustrate only various embodiments of the present invention and are therefore not to be considered limiting of its scope, for the invention may admit to other equally effective embodiments.

DETAILED DESCRIPTION

Figure 1:
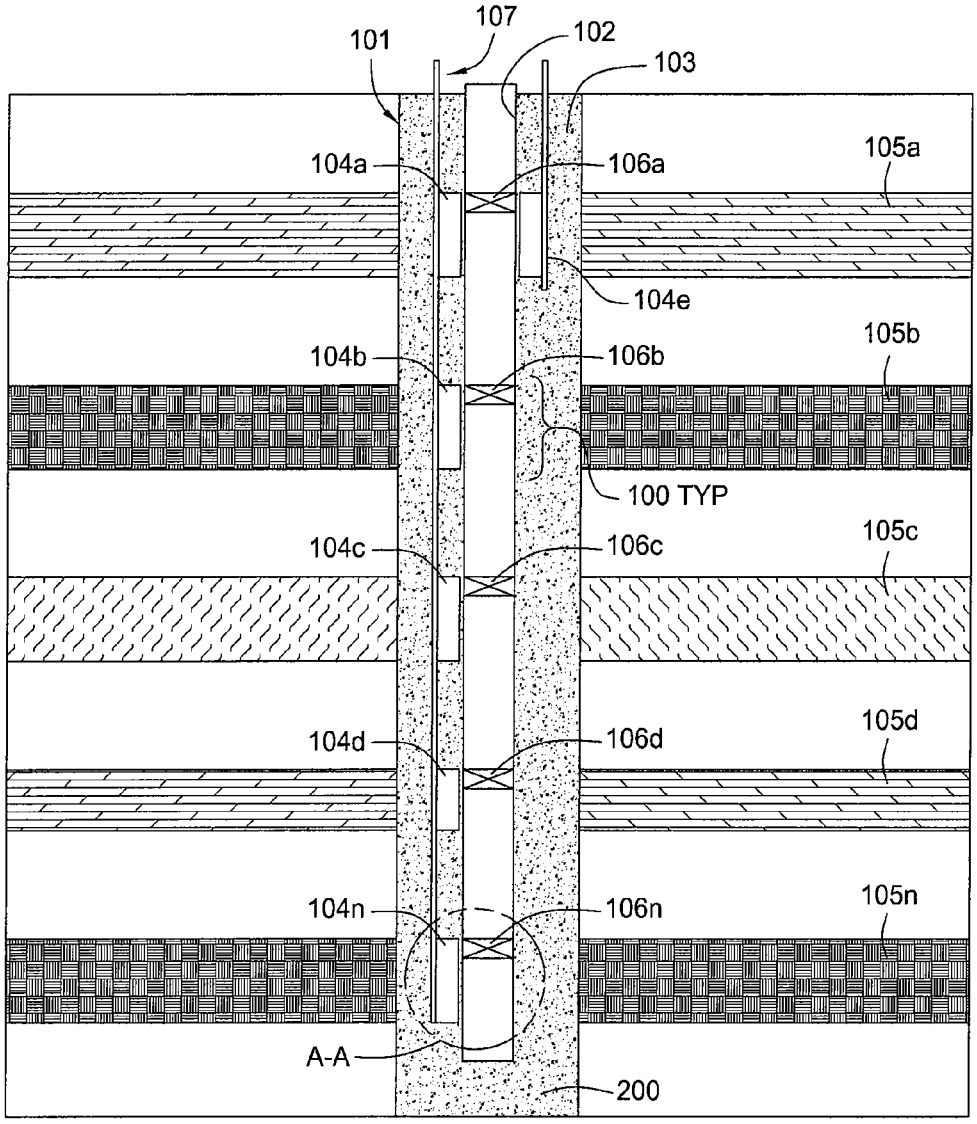
FIG. 1 is a schematic view of a cased well bore including downhole assemblies according to one embodiment.

FIG. 1 shows a schematic view of a cased wellbore 101. A casing 102 is positioned inside the wellbore 101. An annulus 103 between the casing 102 and the wellbore 101 is preferably filled with cement 200 in order to anchor the casing and isolate one or more formations or production zones 105A-N. "A-N" is used herein to indicate a variable number of items so designated, where the number of such items may be one or more up to and including any number "N". Optionally, any item designated with the suffix "A-N" may include one or more whether or not the suffix is used in a given context. Alternatively, portions of or all of the wellbore 101 may not include cement 200 and zonal or formation isolation may be provided, for example, by external casing packers or expanded metal pipe. In one embodiment, the wellbore 101 includes: one or two or more assemblies 100 for selectively establishing fluid communication between a bore 108 of the casing 102 and one or more production zones 105A-N. Preferably, the assemblies 100 are integrated with the casing 102 prior to placement in the wellbore 101 and are then lowered with the casing 102 into the wellbore 101 as an integrated assembly or assemblies 100. Each assembly 100 includes one or more energetic devices 104A-N, and one or more valve members 106A-N. The one or more energetic devices 104A-N may be provided at each of the production zones 105A-N. The energetic devices 104A-N may comprise any suitable perforating mechanism. Exemplary energetic devices 104A-N may comprise perforating guns. Any or all of the energetic devices 104A-N may comprise propellant carrier systems and in one embodiment one or more energetic devices 104A-N may comprise a shaped charge perforating gun with propellant inside and/or outside the perforating gun. One or more of the energetic devices 104A-N may comprise any suitable pressure generating system, perforating system or combinations thereof such as, for example, those disclosed in U.S. Patents U.S. Pat. No. 5,598,891 to Snider et. al, U.S. Pat. No. 5,775,426 to Snider et. al., U.S. Pat. No. 6,082,450 to Snider et. al. and U.S. Pat. No. 6,263,283 to Snider et. al., each of those patents is incorporated herein in its entirety by reference. Each of the energetic devices 104A-N is capable of perforating or impinging penetrating energy upon subterranean formations or production zones 105. In one embodiment, the energetic device 104 is an explosive shaped charge perforating gun. The energetic devices 104A-N may be selectively initiated from the surface by control lines 107. Optionally, the energetic devices 104A-N may be initiated by radio frequency identification ("RFID") tags and readers where one is connected to the energetic device 104 and the other is conveyed from the earth surface or elsewhere within the well. Other suitable initiation signal mechanisms include fiber optics, electric wire, wireless electromagnetic telemetry, acoustic or other wireless communication mechanisms, well bore pressure or pressure pulsing either inside and/or outside of any well bore tubular, well bore fluid flow including circulation, and/or any suitable combinations of the foregoing wherein a corresponding signal receiver is operatively connected to an initiator of the energetic device 104. One or more energetic devices 104 may be located next to the same production zone 105 and may be positioned in one or more circumferential and/or axial locations relative to the casing. Shown by way of example, the production zone 105A includes two energetic devices 104A and 104E positioned circumferentially at approximately 180 degrees from each other at the same axial location within wellbore 101. Any suitable angular displacement may be used however, and any suitable number, one, two or more, of energetic devices 104 may be located around the casing in a similar fashion and/or axially spaced at one or more of the zones 105.

Referring to FIG. 1, the one or more energetic devices 104A-N disposed within the annulus 103 and may be positioned outside of the casing and aligned or oriented to perforate the production zones 105A-N. Optionally, the casing 103 adjacent the energetic devices 104A-N may be undersized and eccentrically positioned within the wellbore thereby creating more room for the energetic devices 104A-N. The perforators of the energetic devices 104A-N are configured to direct energy radially outward of the energetic device in selected directions only. Preferably, the energetic devices 104 A-N are oriented such that they will perforate adjacent formations 105 but will not perforate the casing 102. To establish fluid communication between one of the subterranean formations 105A-N and the casing 102, the energetic device 104 is functioned and thereby causes penetration of the adjacent production zone 105 without penetrating the casing 102. The energetic device 104, although shown as parallel to the casing 102, may have any configuration, for example, it may be helically wound around the casing 102, so long as the energetic device 104 is arranged to perforate the production zone 105 without perforating the casing 102.

Figure 2:
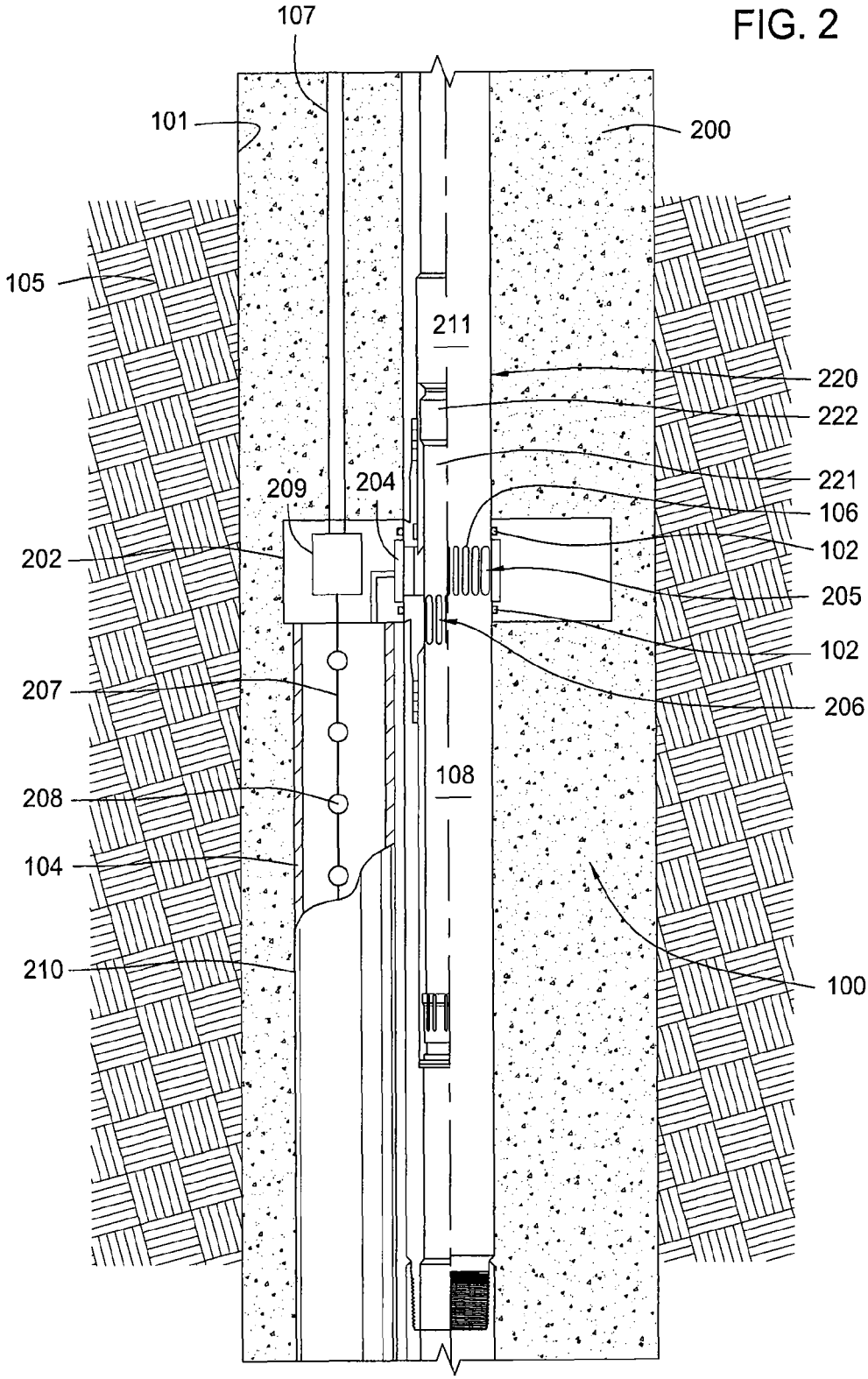
FIG. 2 is a schematic view of a downhole assembly according to one embodiment.

FIG. 2 shows a typical assembly 100 for selectively establishing fluid communication with the bore 108 and the production zone 105. Related methods and apparatus, improved upon by the disclosure herein, for establishing a fluid communication between a casing and a subterranean formation are disclosed in U.S. Patents U.S. Pat. No. 6,386,288, to Snider et al., U.S. Pat. No. 6,536,524 to Snider, and U.S. Pat. No. 6,761,219 to Snider et. al., each of those patents is incorporated herein in its entirety by reference. The energetic device 104 is located within the annulus 103. The energetic device 104 is positioned adjacent to the casing 102 and the production zone 105.

Figure 3:
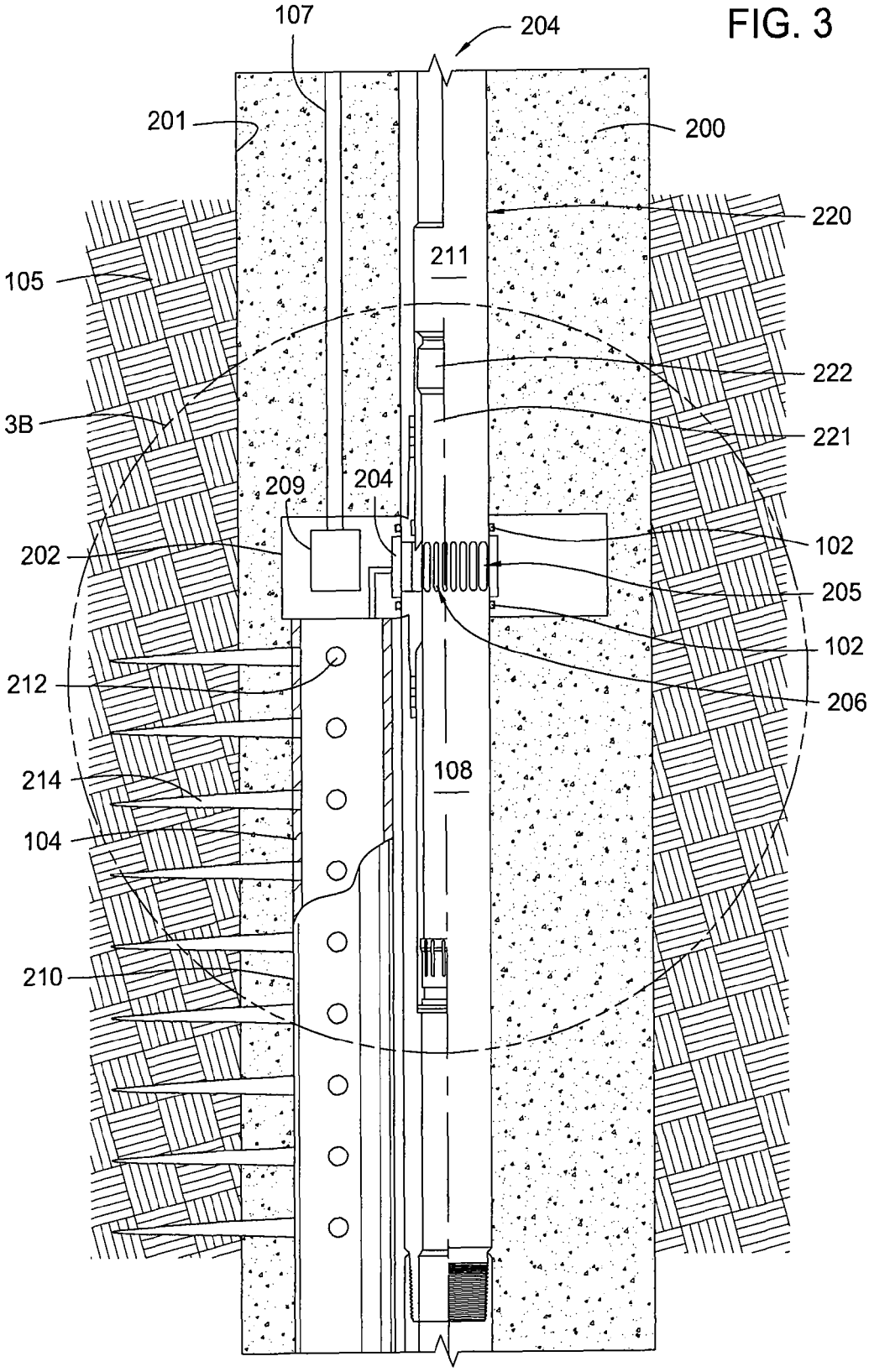
FIG. 3 is a schematic view of a downhole assembly according to one embodiment.
Figure 3B:
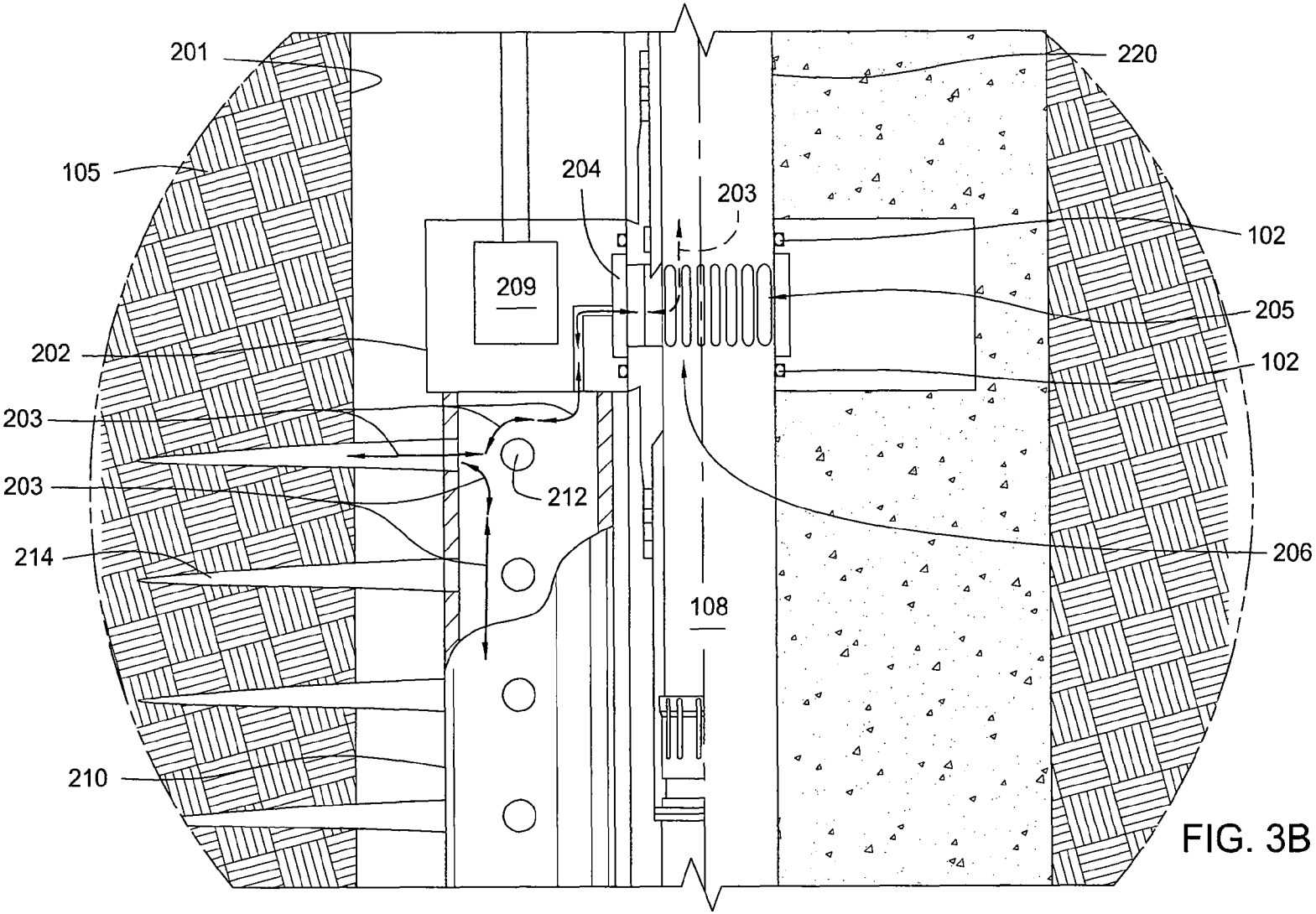
FIG. 3B is an enlarged view of a portion of FIG. 3.

An expanded view of the typical assembly 100, as contained within A-A of FIG. 1, is shown in FIG. 2. In one embodiment, the energetic device 104 is a perforating gun that comprises at least one and preferably a plurality of explosive charges 208 located within an interior of a conduit 210. It should be noted that the energetic device 104 may be any suitable perforating device. In one embodiment, the energetic device 104 includes a firing head 209 carried on the conduit 210 for detonating the explosive charges 208. The firing head 209 is attached to a detonating cord 207 that runs lengthwise through the conduit 210. The firing head 209 may be actuated using a control line from the surface, wellbore pressure, RFID tag/reader system, EM telemetry, or any suitable actuation mechanism. Each of the explosive charges 208 is positioned adjacent to the cord 207. When the firing head 209 is functioned it outputs a detonating energy. That energy is transferred to the cord 207 thereby detonating it and subsequently detonating the explosive charges 208. In one embodiment, the charges in the gun 104 are oriented such that the perforations 214 generated thereby penetrate cement 200 and adjacent formation but do not penetrate the casing 102. The explosive charges 208 penetrate the wall of the conduit 210 and into the adjacent production zone 105, creating one or more holes 212 in the perforating gun 104 and one or more perforations 214 in the production zone 105, as shown in FIG. 3. A flow path 203 is thereby created between the production zone 105, the perforations 214, the holes 212 and the conduit 210. In one embodiment, the energetic device 104 comprises a formation fracturing device such as a fluid pressure generator and upon initiation the energetic device 104 increases fluid pressure locally adjacent the production zone 105, whereby fluid penetrates, and causes fractures or fissures 214 to form in, the zone 105 or formation.

The materials or structures used for supporting the charges 208 and detonating cord 207 within the conduit 210 may be disintegrated partially or completely upon detonation thereby eliminating potential obstructions in the flow path 203 through the energetic device 104. Alternatively, the entire energetic device 104, including any conduit 210, may disintegrate leaving an axial tunnel through the surrounding cement in the annulus 103 wherein that tunnel is adjacent and in fluid communication with the exterior of the aperture 205 and/or valve 106 portion of the casing 102. Under circumstances where cement is not present in the annulus 103, either the annulus 103 and/or the conduit 210 may form a suitable fluid flow path 203 between the production zone 105 and an interior of the casing 102.

Once the formation has been perforated, fluid communication between the production zone 105 and the bore 108 may be selectively established by operating the valve member 106. When the valve 106 is opened as shown in FIG. 3, fluid flows from the production zone through the perforations 214, the holes 212, the conduit 210, the connector 202, the openings 205, 206 and into the interior 108 of the casing 102. Alternatively, fluid may flow from the interior 108 of the casing 102 to the production zone 105 through the above described flow path in the reverse sequence. When the valve is closed, fluid may flow from the production zone through the perforations 214, the holes 212, the conduit 210, the connector 202 and to an exterior of the openings or apertures 205. Fluid may also flow through the interior of the casing 102 and to the openings 206. The valve 106 may be selectively opened to establish fluid communication between the bore 108 and the fluid communication path 204 and hence flow path 203.

The valve 106 may be selectively opened and/or closed from the surface by electric, hydraulic and/or fiber optic control lines. Examples of a control line operated valve system are described in U.S. Pat. No. 6,179,052 to Purkis et. al., and that patent is incorporated herein, in its entirety, by reference. In some embodiments the valve 106 includes a stored energy source such as, for example, a battery. The valve 106 may be opened and closed by the operation of fluid pressure on a suitably arranged down hole piston surface or by operation of electrical or optic energy on a suitable actuator, such as for example, a motor or solenoid. Optionally, the valve 106 may be signaled to function by radio frequency identification ("RFID") tags and readers where one is operatively connected to the valve 106 and the other is conveyed from the earth surface or elsewhere within the well. Other suitable function initiation signal or power transmission mechanisms include fiber optics, electric wire, wireless electromagnetic telemetry, acoustic or other wireless communication mechanisms, well bore pressure or pressure pulsing either inside and/or outside of any well bore tubular, well bore fluid flow including circulation, and/or any suitable combinations of the foregoing wherein a corresponding signal receiver is operatively connected to an actuator of the valve 106. Optionally, the valve 106 is configured to selectively open and close multiple times thereby facilitating multiple discretionary stimulation/treatment, production, and/or shut-in periods. In one embodiment the valve 106 is configured to open automatically in response to a functioning or initiation of the energetic device 104. Such an automatic opening may be selected to occur at a designated time period before or after, or immediately upon, the functioning of the energetic device 104. Following such an automatic opening, the valve 106 may be selectively closed and reopened using any suitable shifter tool or signal/power transmission mechanism.

In one embodiment the valve member 106 is a sliding sleeve 220 and is disposed within the casing string 102. Alternatively, the valve member 106 may be a downhole choke and valve members 106 may comprise downhole chokes, sliding sleeves and other suitable downhole valves either alone or in combination. A sliding sleeve is a downhole tool, connected to or integral with a tubular, that selectively permits and prevents fluid flow through a wall of the tubular. An example of an axially movable sliding sleeve valve is disclosed in U.S. Pat. No. 5,263,683 to Wong and that Patent is incorporated herein, in its entirety, by reference. In one embodiment, the tubular is the casing 102 through the well bore 101. The tubular may however, be any down hole tubular such as, liner, tubing, a drill string, coiled tubing, etc. In one embodiment the sliding sleeve 220 comprises a body portion 221 having one or more openings 205 and a flow control sleeve 222 coaxially and moveably disposed within the body portion 221. The sliding sleeve 220 is operated to selectively align and misalign the first openings 205 and the second openings 206. Openings 205 are in a portion of the casing 102 or body 221 and openings 206 are in the sleeve 220. The flow control sleeve 222 is movable to cover and uncover the openings 205. The flow control sleeve 222 may be axially or rotationally moveable. In one embodiment the flow control sleeve 222 is axially movable between valve open and closed positions. Shifter tools may be lowered into the interior of casing 102 and are utilized to move the flow control sleeve 222 between a valve open and valve closed position. Alternatively, hydraulics can be used to open or close sliding sleeve 220.

When openings 205 and 206 are in line, the bore 108 of the casing 102 is in fluid communication with an exterior of the casing 102 and preferably with fluid communication path 204 of the connector 202. Fluid communication path 204 is in communication with fluid flow path 203 of the conduit 210 and fluid may flow through the perforations 214 into the paths 203, 204 between the bore 108 of tubular 103 and the formation 105. Fluid communication between fluid communication path 204 and bore 108 may be selectively established and disestablished by aligning and misaligning openings 205 and 206.

In one embodiment wherein a valve 106 may not be present, the apertures 205 are created in situ either before or after the functioning of the energetic device 104. A casing perforating device is lowered into the bore 108 to a desired location proximate a zone 105A-N of interest and is functioned thereby creating an aperture or apertures 205 in a wall of the casing 102. Such a casing perforating device may comprise a specialized shallow penetration perforating gun including a shaped charge or charges, known as "tubing punch" charges. Such charges are specifically configured to perforate a wall of a tubular with only minimal residual penetration. A valve or plug member may be inserted into the well bore to close the apertures 205 where such closure is desired.

In one embodiment, connectors 202 couple an upper and/or a lower end of the energetic device 104 to the casing 102. Connectors 202 may comprise sleeves positioned around at least a portion of the exterior of the casing 102 and the aperture or apertures 205. Optionally, the connectors 202 may be sealed around the exterior of the casing 102. Connector 202 has a fluid communication path 204 that runs along the interior thereof and is in fluid communication with the apertures 205. The fluid communication path 204 is in fluid communication with a flow path 203 of the energetic device 104. One or more connectors 202 may be located at any location along the energetic device 104 and casing 102 to allow more entry points for fluid communication between the formation 105 and the bore 108. The connectors preferably located in correspondence with apertures in the wall of the casing 102 or a body portion 221.

In one embodiment, flow path 203 of the energetic device 104 runs axially through the conduit 210 and fluid may flow between the perforated production zone 105 and the aperture 205 and/or connector 202 through the conduit 210. The flow path 203 may initially exist within the conduit 210 or may be created when the energetic device 104 perforates the production zone 105. The flow path 203 allows fluid to flow to and/or from the production zone 105 through the perforations 214, the holes 212, and the conduit 210. Conduit 210 may formed by the body of the energetic device 104. Fluid flows axially through the interior length of conduit 210 and into the connectors 202 which are in communication with an aperture 205 of the valve 106 or casing 102. Each connector 202 has a fluid communication path 204 for placing the bore 108 of the casing 102 in fluid communication with the flow path 203. Each of the connectors 202 is located adjacent to and in fluid communication with an exterior of at least one corresponding aperture 205 and/or valve 106.

In one embodiment, the conduit 210 of the functioned energetic device 104 serves as a manifold to collect or distribute fluids from or to respectively, a plurality of paths, such as the perforations 214 and/or cracks in the cement filling the annulus 103. Such an embodiment may be particularly advantageous under circumstances where any zone or zones 105A-N is long and/or vertically less permeable to fluid flow. Following the functioning of the energetic device 104, the conduit 210 provides a relatively clear flow path over the vertical length of the perforated zone 105. Alternatively, such a flow path may be provided by a void that remains following the functioning of the energetic device 104. Fluid collection or distribution apertures 205 may be situated at a limited number of axial locations along the vertical length. Distributed volumetric flow rate between the vertical length and the apertures 205 is not diminished by a relative scarcity of apertures 205 because fluid may freely travel vertically along an interior of the conduit 210 between the apertures 205 and the distributed vertical length of the zone 105.

In one embodiment, fluid may flow directly between the formation and the connector 202 or apertures 205, thereby bypassing any conduit 210, following the perforation of the zone 105. In one embodiment the system includes an energetic device 104 and an aperture 205, but does not necessarily include a connector and therefore the apertures 205 are in direct fluid communication with an area of annulus, cement, and/or formation surrounding the casing 102 or body 221. The functioning of the energetic device 104 creates sufficient fluid communication pathways from the formation to the exterior of the casing 102 such that communication between an interior 108 of the casing 102 and the formation 105 may be established without the necessity of a flow path through the conduit 210. Flow paths may include perforations 214, cracks in the cement in the annulus 103, a void in the cement in the annulus 103 left by a disintegrating energetic device 104 or any other path suitable for fluid flow.

In one operational embodiment of the plurality of assembles 100A-N, it is desirable to treat hydrocarbon bearing formations 105A-N with pressurized treatment fluids without making multiple trips into the wellbore 101. To ensure that a proper treatment is performed on a particular formation 105, it is desired that the particular formation 105 be isolated from other formations 105 traversed by the wellbore 101 during such treatment. For performing prior to such a treatment operation, the assemblies 100A-N, shown in FIGS. 1, 2 and/or 3, may include one or more of the valves 106 and energetic devices 104 per zone 105A-N and/or per wellbore 101. The assemblies 100A-N are located adjacent one or more of each of the respective production zones 105A-N. Any, one or more, or all of the energetic devices 104A-N may be initiated selectively or simultaneously thereby perforating the respective adjacent production zones 105A-N. With one or more of the production zones 105 perforated, one or more flow paths 203 are created from the zones 105 through the energetic device 104 to the fluid communication path 204 of the connector 202. One or more of the valve members 106 remain in a closed position until it is necessary to establish fluid communication with the bore 108 of the casing 102. A shifting tool or other suitable valve operating mechanism is conveyed into the wellbore and located in an operational relationship with the valve 106. The valve member 106 is then opened thereby opening a flow path between the formation 105 and the bore 108.

Alternatively, the valve 106 may include an operating piston configured to move in response to a differential pressure between an interior and an exterior of the casing or between two select locations within the casing wherein movement of the piston operates the valve 106 between an open and closed position. Additionally or alternatively, such a piston may be acted upon by a pressure established in a control line from the surface. Once the valve 106 is opened, pressurized treatment fluids (not shown) are introduced into the corresponding production zone 105 through the openings 206 of the valve member 220, the openings 205 of the casing 102 and through the fluid communication path 204 of the connector 202. The pressurized fluids then flow through flow path 203 of the energetic device 104, into the perforations 214 created by the energetic device 104 and into the production zone 105. Each of the closed valve members 106 isolate their respective production zones 105 such that those zones remain isolated from the pressurized fluids while the treatment operation is performed. Once the treatment operation is complete, the open valve member 106 may then be closed until the zone 105 is to be produced or some other fluid communication is required. This process may be repeated at any number of production zones 105A-N in the wellbore 101.

When the one or more treatment operations are complete, the wellbore 101 may be prepared to produce production fluid. Preferably, production tubing (not shown) is run into the wellbore 101 above the production zone 105A-N to be produced. Preferably, any overbalanced hydrostatic pressure above the production zones 105A-N in the bore 108 may be relieved before the valve member 106A-N for the corresponding zone or zones 105A-N is opened. With the valve or valves 106A-N open, the production fluid flows into the bore 108. Each production zone 105 may be produced in the same manner, and at the same time or different times and/or in different manners as desired. Once production in any given zone is complete, the corresponding valve member 106A-N may be closed, thereby isolating that production zone 105A-N from the bore 108.

While the foregoing is directed to embodiments of the present invention, other and further embodiments of the invention may be devised without departing from the basic scope thereof, and the scope thereof is determined by the claims that follow.

The invention claimed is:

1. An apparatus for penetrating a formation and selectively establishing fluid communication with the formation, comprising:

a casing having at least one aperture through a wall thereof and comprising a valve member having a first position wherein the aperture is obstructed and a second position wherein the aperture is open; and at least one energetic device positioned exterior of the casing and configured to penetrate a formation surrounding the casing without penetrating the casing.

2. The apparatus of claim 1, wherein the valve member comprises a sliding sleeve.

3. The apparatus of claim 1, further comprising a fluid flow path between an interior of the energetic device and the aperture.

4. The apparatus of claim 3, further comprising a connector sealing contact between the energetic device and an exterior of the casing, the connector including at least a portion of the flow path.

5. The apparatus of claim 1, wherein the energetic device comprises a perforating gun.

6. The apparatus of claim 5, further comprising explosive perforating charges orientated to aim away from the casing.

7. The apparatus of claim 6, wherein the energetic device comprises a manifold.

8. The apparatus of claim 6, further comprising a perforating charge support structure wherein the perforating charges and the support structure are disintegratable upon a functioning of the perforating gun.

9. The apparatus of claim 5, wherein the perforating gun comprises a conduit.

10. The apparatus of claim 1, wherein the energetic device includes a fluid flow path there through following a perforating, by the energetic device, of the formation surrounding the casing.

11. The apparatus of claim 10, further comprising at least one connector surrounding an exterior of the casing and the at least one aperture and having at least a portion of the flow path there through.

12. The apparatus of claim 1, wherein the casing and the energetic device are connected as an assembly prior to lowering into a well bore.

13. A method for selectively establishing fluid communication between an interior of a casing and a formation of interest, comprising:

penetrating the formation of interest while not perforating the casing, using an energetic device; and opening a fluid flow path between the formation of interest and an interior of the casing.

14. The method of claim 13, wherein the penetrating comprises perforating with a perforating gun.

15. The method of claim 14, further comprising disintegrating an interior structure of the perforating gun.

16. The method of claim 13, wherein the opening comprises opening a valve.

17. The method of claim 16, wherein the valve comprises a sliding sleeve.

18. The method of claim 13, further comprising flowing a fluid through the flow path.

19. The method of claim 18, further comprising flowing a fluid through the energetic device.

20. The method of claim 18, wherein flowing the fluid comprises flowing a treatment fluid from the interior of the casing to the formation of interest.

21. The method of claim 13, further comprising closing the fluid flow path.

22. The method of claim 13, further comprising lowering the casing and the energetic device as an integrated assembly into a well bore.

23. A down hole fluid collection and distribution apparatus comprising:

an elongate manifold disposable exterior of a casing and having a first configuration wherein an interior of the manifold is fluidically isolated from a well bore there around and a second configuration including at least two axially spaced perforations through at least one of a wall and walls of the manifold; and a fluid flow path within the manifold, the flow path in fluid communication with the two perforations and at least one aperture of the casing, the aperture being axially spaced from the perforations.

24. The apparatus of claim 23, wherein the aperture further includes a valve member.

25. The apparatus of claim 24, wherein the valve member comprises a sliding sleeve.

26. The apparatus of claim 23, wherein the first configuration further comprises a perforating mechanism contained within the manifold.

27. The apparatus of claim 26, wherein the perforating mechanism comprises an explosive shaped charge.

28. The apparatus of claim 23, wherein the manifold is substantially parallel with the casing.

29. A method for fluidically accessing distributed locations within a downhole formation comprising:

providing a fluid flow path traversing a length of the formation, the flow path being in fluid communication with an interior of a casing positioned inside a well bore and with longitudinally distributed locations in the formation, wherein the flow path is exterior of the casing and along an axis substantially parallel thereto, and the interior of the casing is otherwise substantially isolated from the longitudinally distributed locations;

flowing a fluid in at least one of a direction from the interior of the casing to the distributed locations and a direction to the interior of the casing from the distributed locations; and wherein the fluid communication between the flow path traversing the length of the formation and the interior of the casing is selectively closable.

30. The method of claim 29, wherein providing the fluid flow path further comprises perforating the formation.

31. A method for treating multiple formations traversed by a well bore comprising:

providing a well bore casing in a well bore and having at least one perforating gun positioned exterior thereof and adjacent a first formation and at least one second perforating gun positioned exterior thereof and adjacent a second formation;

functioning the perforating gun thereby providing first lengthwise distributed perforations in the first formation without perforating the well bore casing;

selectively opening at least one aperture in the well bore casing;

pumping a fluid from an interior of the well bore casing, through the aperture and into the first distributed perforations;

closing the aperture; and functioning the second perforating gun thereby providing second lengthwise distributed perforations in the second formation without perforating the well bore casing.

32. The method of claim 31, further comprising selectively opening at least one second aperture in the well bore casing.

33. The method of claim 31, further comprising pumping a fluid from an interior of the well bore casing, through the second aperture and into the second distributed perforations.

* * * * *